US007708232B2

(12) United States Patent
Mace et al.

(10) Patent No.: US 7,708,232 B2
(45) Date of Patent: May 4, 2010

(54) RAILROAD CAR LATERAL INSTABILITY AND TRACKING ERROR DETECTOR

(75) Inventors: Stephen E. Mace, Pueblo, CO (US); Stephen N. Handal, Colorado Springs, CO (US); Robert W. Martin, Colorado City, CO (US)

(73) Assignee: Progressive Rail Technologies, Inc., Pueblo West, CO (US)

( * ) Notice: Subject to any disclaimer, the term of this patent is extended or adjusted under 35 U.S.C. 154(b) by 1117 days.

(21) Appl. No.: 11/169,553

(22) Filed: Jun. 29, 2005

(65) Prior Publication Data

US 2006/0261218 A1 Nov. 23, 2006

Related U.S. Application Data

(60) Provisional application No. 60/682,537, filed on May 19, 2005.

(51) Int. Cl.
*B61K 1/00* (2006.01)
*B61L 5/12* (2006.01)

(52) U.S. Cl. ..... 246/167 R; 246/473 R

(58) Field of Classification Search ..... 246/167 R, 246/169 R, 185, 201, 473 R
See application file for complete search history.

(56) References Cited

U.S. PATENT DOCUMENTS 4,283,031 A * 8/1981 Finch ..... 246/128
4,412,212 A 10/1983 Kolegraff et al.
5,198,800 A 3/1993 Tozawa et al.
5,331,311 A * 7/1994 Doctor ..... 340/463
5,529,267 A * 6/1996 Giras et al. ..... 246/120
5,660,470 A 8/1997 Mench
6,313,753 B1 11/2001 Butler
6,411,215 B1 6/2002 Shnier
6,717,514 B1 4/2004 Stein et al.
6,778,092 B2 8/2004 Braune
6,812,850 B2 11/2004 Matsumiya et al.
7,216,558 B2 * 5/2007 Kumar et al. ..... 73/866.5
2002/0196155 A1 12/2002 McNulty, Jr.
2003/0089530 A1 * 5/2003 Paine ..... 177/163
2003/0160701 A1 8/2003 Nakamura et al.

OTHER PUBLICATIONS

Salient Systems, Inc.—Preventing Trail Derailment web site, address: www.salientsytems.com, printed Feb. 15, 2005.
GE Transportation Rail—Performance Evolution Series Locomotive web site, address: www.getransportation.com, printed Feb. 15, 2005.

* cited by examiner

*Primary Examiner*—S. Joseph Morano
*Assistant Examiner*—Robert J McCarry, Jr.
(74) *Attorney, Agent, or Firm*—Rick Martin; Patent Law Offices of Rick Martin, P.C.

(57) ABSTRACT

The current invention is intended to be installed in revenue service railroad tracks to detect railroad cars exhibiting wheel set lateral instability. The invention utilizes an array of inductive proximity sensors mounted at regular intervals in a section of railroad track. Each proximity sensor is oriented to sense the lateral position of railroad car wheel sets. The invention employs a computer algorithm to extrapolate the trajectory from the set of proximity sensor signals for each wheel set. A second algorithm evaluates the shape of the trajectory to detect oscillating lateral motion of the wheel set. A third algorithm assesses the severity of any wheel set lateral oscillations that are detected. An additional function of the invention is to detect railroad car trucks that exhibit "tracking errors".

11 Claims, 12 Drawing Sheets

EQUATION 1: $L_L = [(\text{First Left } 0 \text{ volt Sensor Index}) \times d_S] - \frac{d_S}{2}$ EQUATION 2: $L_F = [(\text{Last Left } 0 \text{ volt Sensor Index}) \times d_S] + \frac{d_S}{2}$ EQUATION 3: $R_F = [(\text{First Right } 0 \text{ volt Sensor Index}) \times d_S] - \frac{d_S}{2}$ EQUATION 4: $R_L = [(\text{First Left } 0 \text{ volt Sensor Index}) \times d_S] + \frac{d_S}{2}$ EQUATION 5: $\lambda = 2 \times ABS\left[\frac{(L_L + L_F)}{2} - \frac{(R_L + R_F)}{2}\right]$

EQUATION 6: $C_L = L_L - L$

EQUATION 7: $C_R = R_L - R_F$

EQUATION 8: $A_L = \frac{A'_L}{\sin\left[\left(\frac{1}{2} - \frac{C_L}{\lambda}\right)\pi\right]}$ EQUATION 9: $A_R = \frac{A'_R}{\sin\left[\left(\frac{1}{2} - \frac{C_R}{\lambda}\right)\pi\right]}$ EQUATION 10: $A = \frac{A_R + A_L}{2}$ EQUATION 11: $\varpi = \frac{V}{\lambda}$ EQUATION 12: $a_{max} = A\varpi^2$

FIG.10b

RAILROAD CAR LATERAL INSTABILITY AND TRACKING ERROR DETECTOR

CROSS REFERENCE APPLICATIONS

This application is a non-provisional application claiming the benefits of provisional application No. 60/682,537 filed on May 19, 2005.

FIELD OF INVENTION

The present invention relates to using a series of inductive proximity sensors to determine the trajectory of railroad car wheel sets over a section of straight railroad track. The trajectory is analyzed to determine if the wheel sets exhibit an unstable lateral motion or exhibit eccentric lateral tracking positions relative to the track.

BACKGROUND OF THE INVENTION

Freight and passenger railroad car wheel sets can develop sustained lateral oscillations, commonly referred to as high-speed lateral instability or "hunting", while operating on railroad track at elevated speeds. The consequences of wheel set lateral instability include:

1. Excessive suspension wear.
2. Damage to lading carried by railroad vehicles, particularly finished automobiles, electronic products or any items that are sensitive to sustained vibrations.
3. Increased derailment risk.
4. Increased fuel consumption of trains with hunting cars.
5. Reduced train operating speeds.

Lateral instability is a natural consequence of the typical railroad car wheel set design (FIG. 1*a*) that consists of a pair of conical shaped wheels 4,5 mounted rigidly to a solid axle 6. This design is inherently unstable as the wheel set rolls on the rails as shown in FIGS. 1*a* and 1*b*. A slight lateral displacement of the wheel set 4, 5, 6 toward the left rail 2 causes the effective rolling radius of the two wheels of the wheel set to change, with the effective rolling radius of the left wheel 4, $r_{left}$, increasing and that of the right wheel 5, $r_{right}$, decreasing. Because the wheels 4,5 are connected via a rigid axle 6, they cannot rotate independently of one another. The difference in their rolling radii ($r_{left}>r_{right}$) caused by the lateral shift creates longitudinal and lateral creep forces $F_{creep}$ at the wheel/rail contact area 100, 101 that act to restore the wheel set back to its equilibrium position on the rails.

However, due to insufficient damping forces in this simple mechanical system the wheel set will tend to oscillate laterally around its equilibrium position, as shown in FIG. 1*a*. The magnitude and frequency of this lateral oscillation depends on several factors, including the amount of taper ($T_1$, $T_2$) of the wheel tread cross section, the friction between the wheels 4, 5 and rails 2, 3 the lateral alignment of the railroad track, the design and condition of the railroad car's suspension and, most importantly, the weight and speed of the railroad car, which is shown traveling into the page for FIGS. $\mathbf{1}_a$, $\mathbf{1}_b$. Lateral instability tends to increase as railroad car weight decreases and speed increases.

Railroad cars have suspensions commonly referred to as "trucks" or "bogies". Several different types of trucks are currently used in railroad cars, but most consist of two or more rigid axle wheel sets contained within a framework that rotates horizontally under the railroad car body to negotiate curves. FIG. 2 shows top views of a typical railroad car truck 7 with laterally unstable wheel sets at five locations $L_1 \rightarrow L_5$ along the track. The lateral oscillations of the wheel sets 4,5,6 are shown, and their trajectories 20, 21 are represented as the dashed lines passing through each wheel. $L_1$ shows truck 7 veering left. $L_2$ shows truck 7 veering right. $L_3$ shows truck 7 veering about straight. $L_4$ shows truck 7 starting to veer left again. $L_5$ shows truck 7 returning past straight again before veering right again.

Attempts have been made to minimize wheel set lateral instability in railroad cars by several methods:

1. The use of cylindrical wheel shapes or wheels with very little tread taper.
2. Increasing the yaw resistance of railroad car suspensions to prevent lateral wheel set oscillations.
3. Adding yaw dampers to railroad car suspensions to damp out the lateral wheel set oscillations.

Unfortunately these methods also tend to degrade the ability of railroad car suspensions to negotiate curves, and they increase the cost and maintenance of railroad car suspensions. Thus, the vast majority of freight railroad cars in service in North America are not equipped with any special equipment to control wheel set lateral instability. As a consequence high-speed instability is remedied by simply replacing wheel sets and truck components when lateral instability is detected.

Truck tracking errors occur when one or more wheel sets in a truck run with a lateral offset toward one rail or the other. The causes of this behavior include:

1. The two wheels of a wheel set have worn to different diameters.
2. Different side/side wheel set center distances ($d_1$, $d_2$) due to defects in the truck frame (FIG. 2, $L_1$)
3. Truck frames 7, locked in misalignment with the railroad car and track due to rotational binding or friction at their pivot point 22 (FIG. 2, $L_1$).

Three truck-tracking situations are illustrated in FIGS. 3*a*, 3*b*, 3*c*. FIG. 3*a* shows the top view of a truck 7*a* in proper alignment with the track. Both wheel sets 30, 31 are in rolling alignment with the track and are centered between the rails. FIG. 3*b* shows a truck 7*b* that is not tracking properly. The truck center member 22 is locked in a rotated position such that neither wheel set 32, 33 in the truck 7*b* is aligned with the track. The misalignment causes both wheel sets 32, 33 to track toward the left rail. In FIG. 3*c* the truck tracking error is characterized by the leading wheel set 35 tracking toward the right rail, and the trailing wheel set 34 tracking toward the left rail.

The current invention utilizes the same array of inductive proximity sensors as the lateral instability detector to detect wheel sets that are tracking toward one rail or the other. The invention also employs an algorithm that evaluates the wheel set trajectory to determine if a wheel set is tracking consistently toward one rail or the other.

Several methods have been previously developed to detect and quantify the lateral instability of railroad cars. Prior art involved placing acceleration or force sensors on individual railroad cars and monitoring these sensors in a series of track tests under controlled conditions. These "on-board" methods of detecting and quantifying lateral instability are not practical for the large number of railroad cars in operation on the freight railroads.

Another lateral instability detection device has been developed for commercial applications by Salient Systems, Inc. This device employs strain gauge force sensors applied to lengths of rail that sense the lateral forces applied by railroad car wheel sets. Proprietary computer algorithms are applied to the wheel set lateral force data to detect lateral force patterns associated with lateral instability.

The lateral force measurement method of detecting lateral instability suffers from the following problems:

1. Lateral force measuring sensors must be applied to the rails and calibrated periodically.

2. The lateral force sensors cannot be removed and reapplied to the rails for track maintenance.

3. Certain track maintenance activities destroy the lateral force sensors.

4. The lateral force sensors are susceptible to voltage surges that propagate along the rails.

5. Lighter railroad cars may generate lateral wheel forces that are below the sensitivity threshold of the sensors and will not be detected even though the railroad car wheel sets are laterally unstable.

The advantages of the lateral displacement measurement method of detecting lateral instability of the present invention compared to the lateral force method include:

1. The lateral displacement sensors of this invention are easily removed from the rails and do not require periodic calibration.

2. The inductive proximity sensors are well isolated from the rails and are less susceptible to damage from voltage surges in the rails.

3. The lateral displacement sensor detection capability is not affected by the magnitude of the lateral wheel force, and very light railroad cars (those more inclined to hunt) are detected as reliably as heavier railroad cars.

The shape of the sinusoidal trajectory of a laterally unstable wheel set is more uniform and easier to characterize compared to the wheel set lateral force time series.

Prior art for detecting truck tracking errors consists of a commercial product offered by Wayside Inspection Devices Inc. (http://www.wid.ca) called the T/BOGI™ system (U.S. Pat. No. 5,368,260). This device consists of a laser/camera range finder system that scans the side of passing railroad car wheel sets to measure their angular orientation and tracking disposition relative to the track.

The disadvantage of this prior art is the complexity and cost of the laser/camera range finder system and the need for periodic cleaning and maintenance. In addition, the T/BOGI™ system obtains one instantaneous measurement of the wheel set tracking position at a single point on the track.

The current invention evaluates the tracking position of the wheel set at several points along the track. Furthermore, the present invention detects light railroad cars, which are most prone to hunt. The present invention is easier to maintain and more resistive to damage caused by voltage surges in the rails.

SUMMARY OF THE INVENTION

An aspect of the present invention is to provide a railroad car lateral instability detection system using an array of inductive proximity sensors located at several points along a length of railroad track and oriented to measure the lateral position of wheel sets relative to the track.

Another aspect of the present invention is to provide a reliable computer algorithm that evaluates the set of wheel set lateral position sensor readings to detect an oscillating pattern indicating lateral instability.

Another aspect of the present invention is to provide a computer algorithm that fits a sinusoidal curve equation to the oscillating pattern of lateral wheel set positions.

Another aspect of the present invention is to provide a computer algorithm that evaluates the sinusoidal curve equation to develop a severity index that is related to the lateral acceleration of the unstable wheel set.

Another aspect of the current invention is to provide a remote alarm communication sub-system connected to the lateral instability detector.

Another aspect of the current invention is to provide a truck tracking error detector within the same system.

Another aspect of the current invention is to provide an algorithm that evaluates the wheel set trajectory to determine if a wheel set is tracking consistently toward one rail or the other, thereby indicating a truck tracking error.

Other aspects of this invention will appear from the following description and appended claims, reference being made to the accompanying drawings forming a part of this specification wherein like reference characters designate corresponding parts in the several views.

An array of inductive proximity sensors are attached to both rails along a length of railroad track and oriented to sense the lateral position of railroad car wheel sets relative to the track. The proximity sensor voltage signals are monitored by a computer running an automatic data collection and control (ADCC) system.

As a train passes over the section of track the lateral positions of the wheel sets in the railroad cars are recorded at each proximity sensor pair by the ADCC system.

After the train passes, the ADCC system applies an algorithm to the data that evaluates the lateral position data set of each wheel set to determine if an oscillating pattern exists. If so, then a second algorithm fits a sinusoidal curve equation to the oscillating pattern of lateral wheel set positions. A third algorithm evaluates the sinusoidal curve equation to develop a severity index that is related to the lateral acceleration of the unstable wheel set.

If an oscillating pattern is not found in the lateral position data of a wheel set, then the ADCC system applies an algorithm that evaluates the data for consistent tracking of the wheel set toward one rail or the other, thereby indicating a truck tracking error.

Concurrent with the data collection activity, the ADCC system scans the car identification radio tags of passing railroad cars as a reference for reporting any cars that exhibit lateral instability or truck tracking errors.

The ADCC program generates electronic reports of any railroad cars exhibiting lateral instability or truck tracking errors and transmits these reports over the railroad communication network to the appropriate destinations.

BRIEF DESCRIPTION OF THE DRAWINGS

FIG. 10*b* shows equations used to calculate lateral acceleration.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1A:
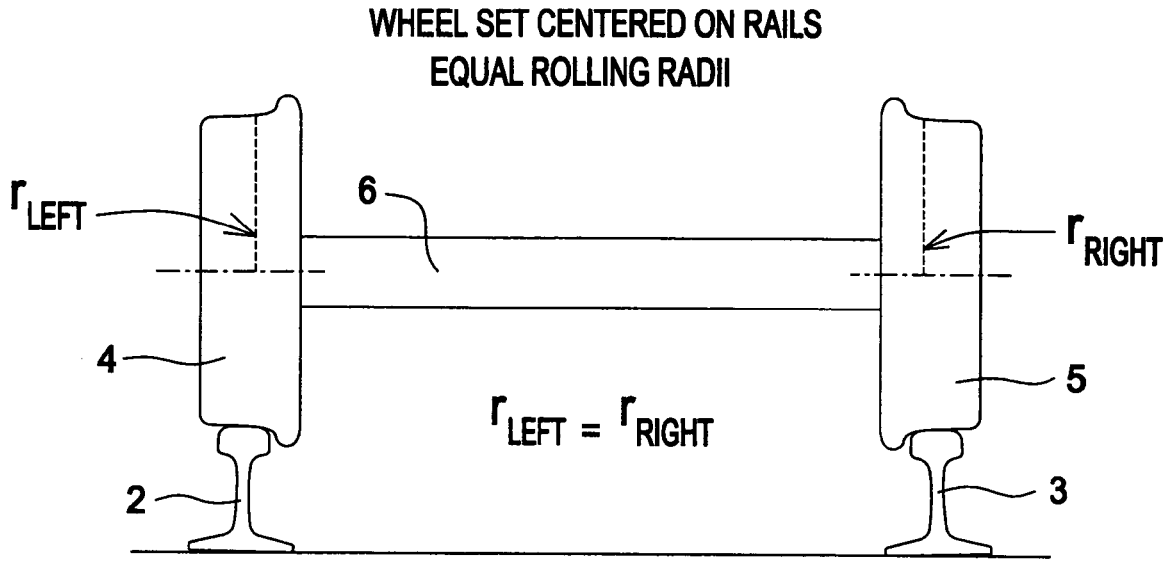
FIG.1A (PRIOR ART)
FIG. 1*a*, prior art, is a front plan view of a centered railroad car wheel set.
Figure 1B:
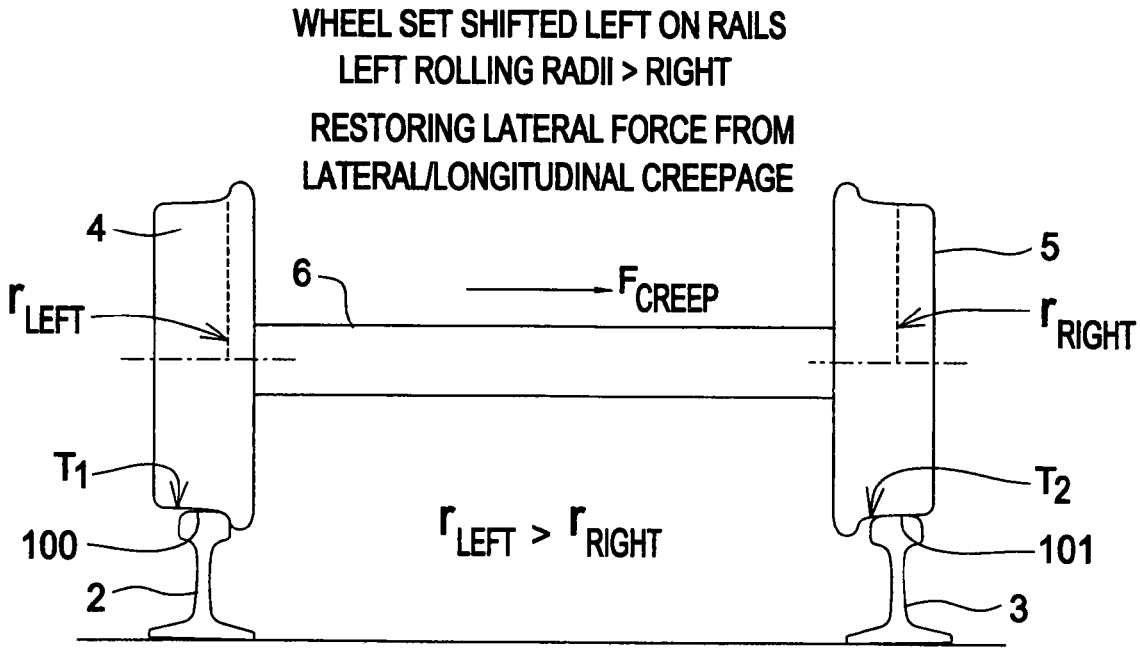
FIG.1B (PRIOR ART)
FIG. 1*b*, prior art, is the same view as FIG. 1*a* illustrating the variation in rolling radii as the wheel set shifts to the left.

Referring first to FIGS. 1*a*, 1*b* an example of wheel set lateral instability is shown. A disturbance or perturbation in the track 2, 3 causes the wheel set 4, 5, 6 to shift laterally from its centered position (FIG. 1*a*) toward the left rail 2 (FIG. 1*b*). Due to the tapered or conical shape of the wheel rim ($T_1$, $T_2$), the lateral shift causes the left wheel 4 to roll on a larger rolling radius than the right wheel 5. Being connected by a rigid axle 6 the wheels 4, 5 are forced to rotate at the same speed. This causes the left wheel 4 to generate longitudinal creep forces as it tries to "pull ahead" of the right wheel 5 because of its larger rolling radius. Consequently the left wheel "steers" the wheel set toward the right rail (traveling into the page) and restores the wheel set to an equilibrium position as shown by force arrow $F_{creep}$. However, insufficient damping in the suspension of the truck containing the wheel set 4, 5, 6 may allow the lateral oscillations to continue, and the wheel set 4, 5, 6 becomes laterally unstable.

Figure 2:
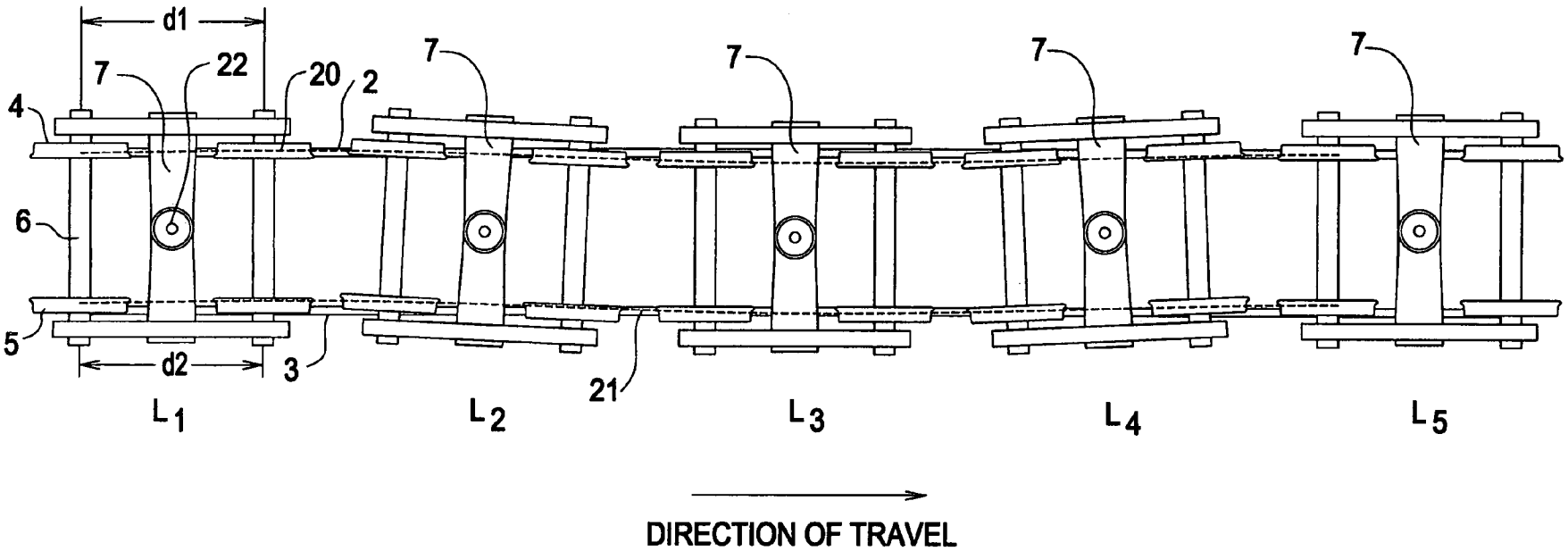
FIG.2 (PRIOR ART)
FIG. 2, prior art, is a top view of a laterally unstable railroad car truck at five positions along the track.

Referring next to FIG. 2 top views of a laterally unstable truck 7 and wheel sets 4, 5, 6 are shown at five positions ($L_1$-$L_5$) along the track 2, 3. The individual wheel 4,5 trajectories are represented by the dashed lines 20, 21.

Figures 3A, 3B, 3C:
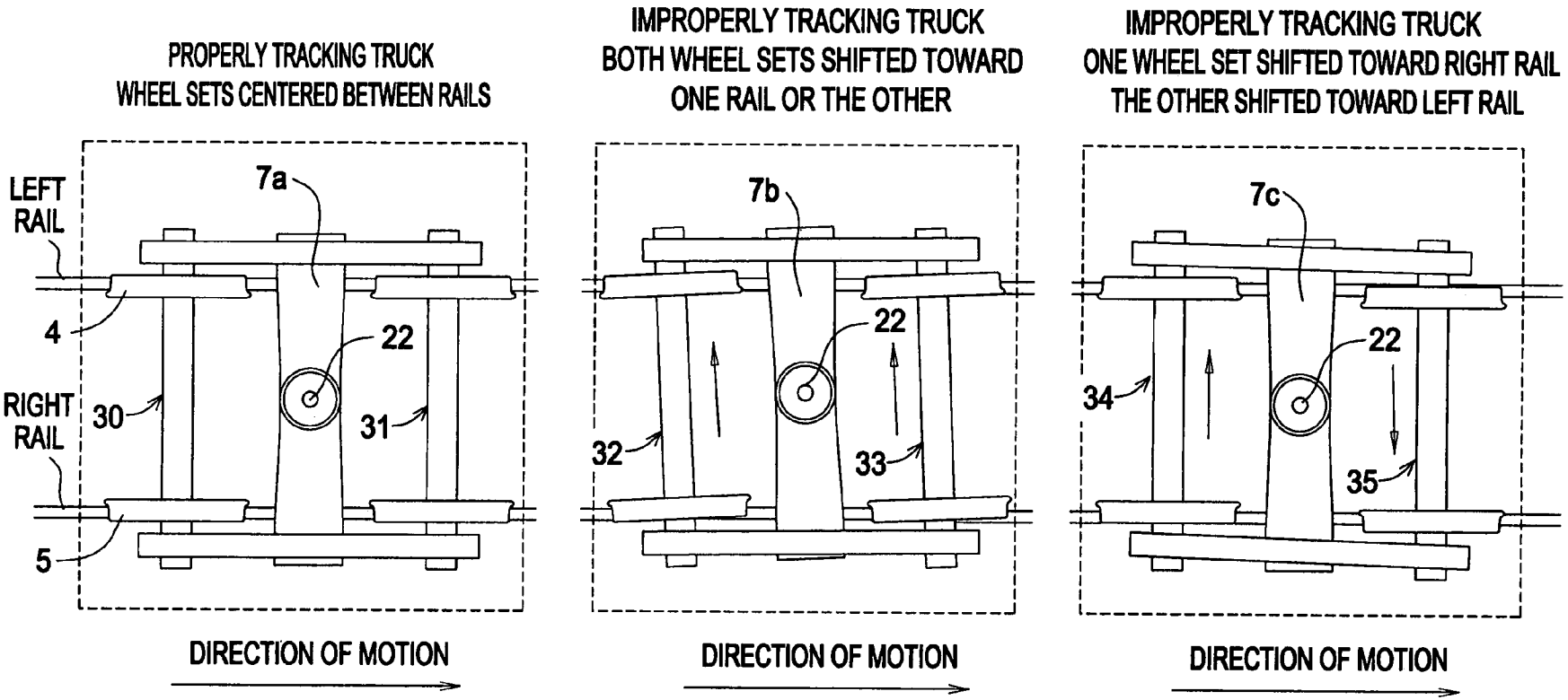
FIG.3c (PRIOR ART)
FIG.3b (PRIOR ART)
FIG.3a (PRIOR ART)
FIGS. 3*a*, 3*b*, 3*c*, prior art, are top views of three truck tracking dispositions.

Referring next to FIGS. 3*a*, 3*b*, 3*c* three truck tracking dispositions are shown. FIG. 3*a* shows a properly tracking truck 7*a* with the wheel sets 30, 31 properly aligned and centered between the rails 2. FIG. 3*b* shows a truck 7*b* with tracking errors in which both wheel sets 32, 33 track toward the left rail. FIG. 3*c* shows a truck 7*c* with tracking errors in which the leading wheel set 35 tracks toward the right rail, and the trailing wheel set 34 tracks toward the left rail.

Figure 4:
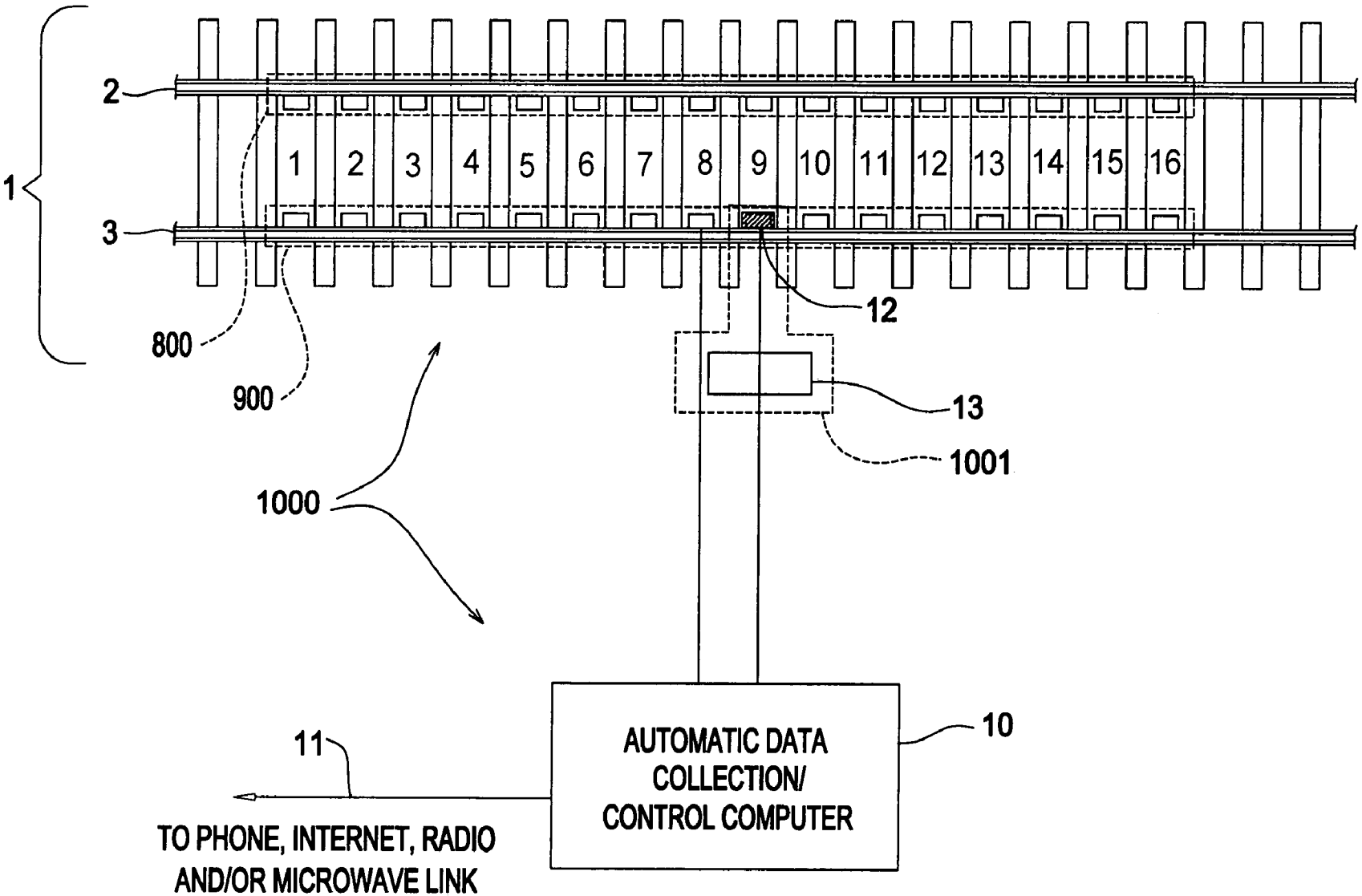
FIG. 4 is a schematic view of the lateral instability/tracking error detection system.

Referring next to FIG. 4 a lateral instability/tracking error detection system 1000 consists of an array of inductive proximity sensors 800 mounted on the left rail 2, and an array of sensors 900 mounted on the right rail 3. Voltage signals from the sensors' arrays are continuously monitored by the automatic data collection and control (ADCC) system 10.

The ADCC system 10 concurrently monitors the railroad car identification system 1001 comprised of the radio identification tag reader 13 and wheel detector 12. The wheel detector 12 generates a voltage pulse as a railroad car wheel passes over the detector 12. These pulses are recorded by the ADCC system 10.

Electronic alerts or reports of railroad cars exhibiting lateral instability or truck tracking errors can be sent by the ADCC system via the phone, internet, radio or microwave link 11 to the appropriate destinations on the railroad communication network.

Figure 5:
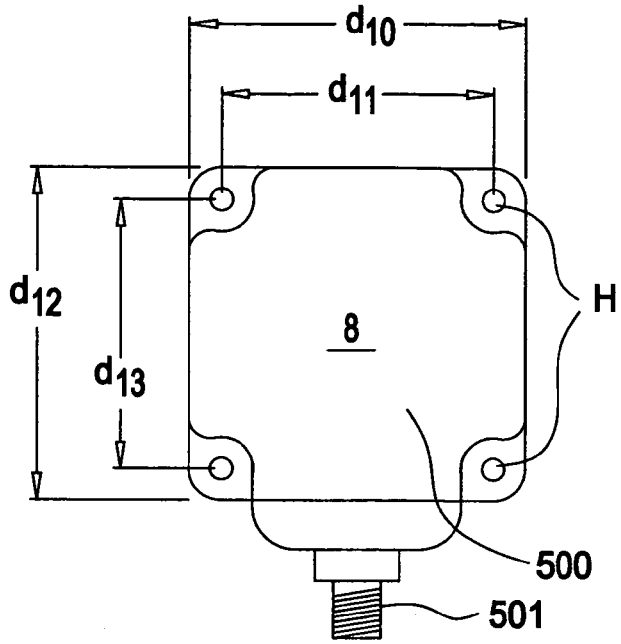
FIG. 5 is a detailed top view of an inductive proximity sensor.

Referring next to FIG. 5 the details are shown of an inductive proximity sensor 8. The sensors used in the preferred embodiment of the current invention are unmodified commercial inductive proximity sensors manufactured by TURCK Inc. Part #Bi50U-Q80-RP6X2-H1143 with a nominal detection range of 0-50 mm, an internal switching relay, a switching frequency of 250 Hz. and an operating voltage range of 10-30 VDC. The sensor 8 employs a high-frequency electrical field generated by a coil embedded within the sensor body. When a ferrous object such as a wheel flange enters the sensor's electrical field, the amplitude of the field voltage decreases and triggers a relay circuit incorporated in the sensor 8. The relay circuit switches an applied voltage to generate a signal that is recorded by the ADCC system.

Nominal dimensions are $d_{10}$=3.150 inch, $d_{11}$=2.550 inch, $d_{12}$=3.150 inch, $d_{13}$=2.550 inch. Mounting holes H are used to mount the sensor 8 to a bracket. Active face 500 is placed near the flange tip point of a passing wheel. The cable connector 501 receives a cable (not shown).

Figure 6A:
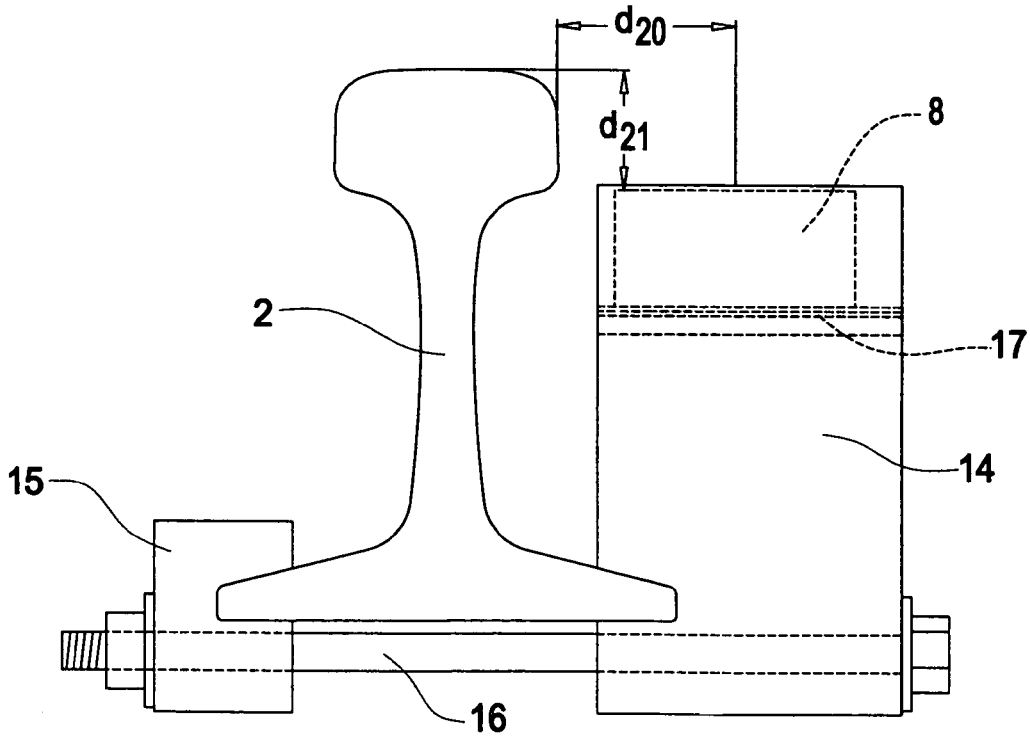
FIG. 6*a* is an end view of the inductive proximity sensor preferred mounting arrangement on standard North American 136-lb rail.
Figure 6B:
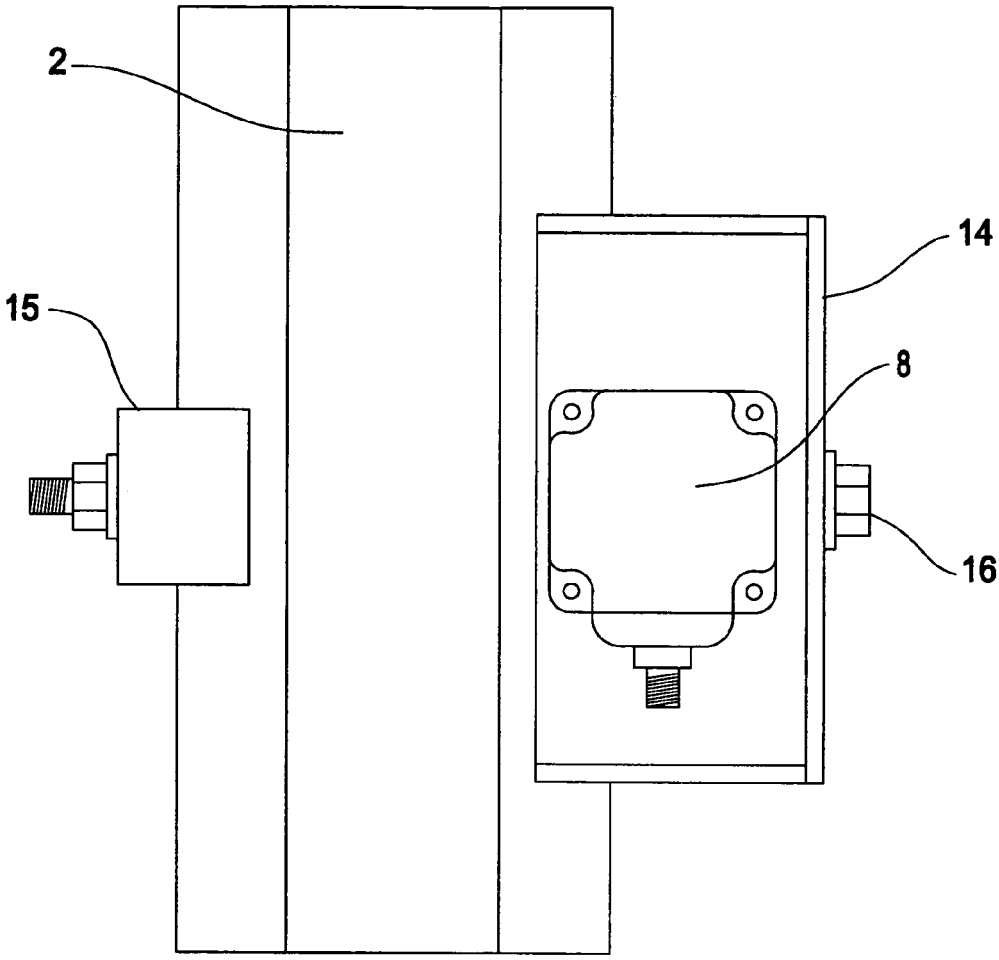
FIG. 6*b* is a top view of the proximity sensor preferred mounting arrangement shown in FIG. 6*a*.

Referring next to FIGS. 6*a*, 6*b* an inductive proximity sensor 8 and mounting bracket 14, clamp block 15 and clamp bolt 16 are shown for an installation of the invention on standard 136-lb railroad rail 2. The dimensions of the sensor mounting bracket 14 must be adjusted according to the rail's size and wear to maintain the sensor 8 at the detection distances from the rail head as shown in FIGS. 6*a*, 6*b*. Shims 17 are used to adjust the height of the sensor 8 in the field to account for railhead wear. Nominal dimensions are d20=2.34 inch, d21=1.6 inch.

Figure 7A:
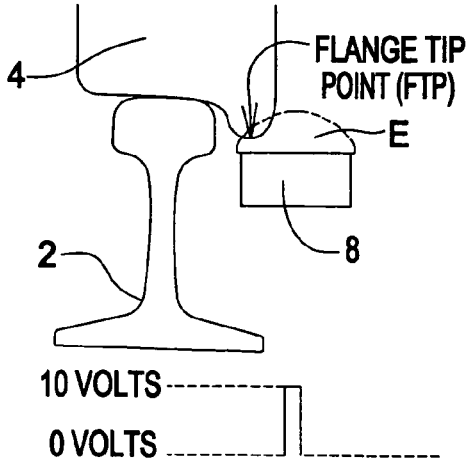
FIGS. 7*a*, 7*b* show a typical wheel flange profile on the rail at two lateral positions relative to the inductive proximity sensor detection envelope.

Referring next to FIG. 7*a* the wheel flange profile 4 is shown on rail 2. Inductive proximity sensor 8 is shown in its preferred mounting position relative to the rail 2. The detection envelope of the proximity sensors have been precisely mapped relative to the wheel "flange tip point" (FTP) using steel targets having the dimensions of a railroad car wheel flange. In FIG. 7*a* and subsequent figures representing the sensors and wheel flange profiles, the flange tip point FTP must fall within the sensor detection envelope E to trigger the sensor relay.

In FIG. 7*a* the wheel flange profile 4 is shown in a position when the wheel set 4, 5, 6 is centered between the rails 2, 3. The flange tip point resides inside the sensor 8 detection envelope E triggering the internal relay and generating the 10 volt signal shown.

Figure 7B:
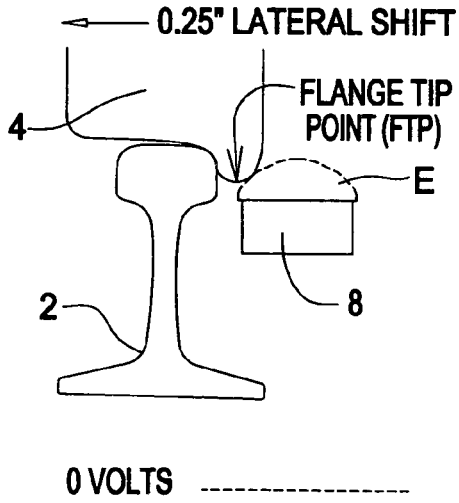

FIG. 7*b* shows the wheel flange profile 4 shifted 0.25-inch toward the rail 2. The flange tip point FTP resides outside of the sensor 8 detection envelope E such that the internal relay is not triggered, and the sensor output voltage remains at 0 volts. The sensors are mounted such that a 00.25-inch lateral shift of the wheel set from the nominal center position toward the rail will result in the wheel flange moving outside of the sensor detection envelope, thereby changing the sensor output from 10 to 0 volts.

Figure 8A:
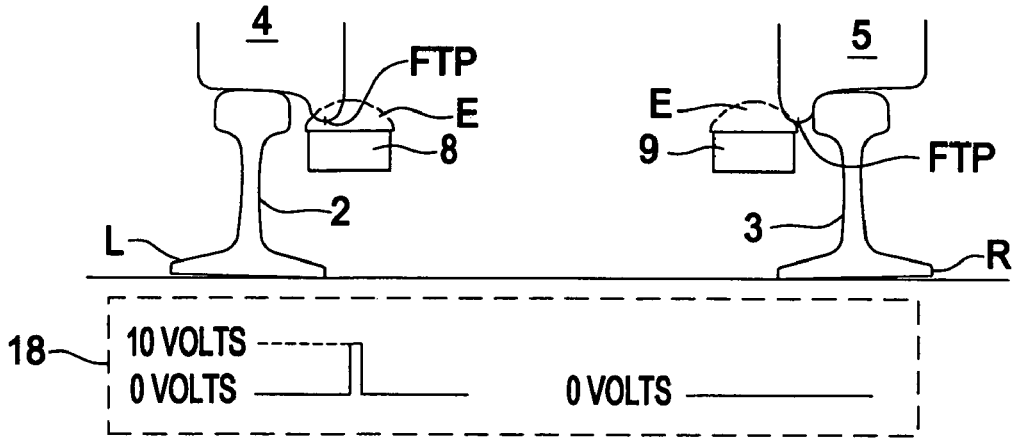
FIGS. 8*a*, 8*b*, 8*c* are views of the wheel set on the rails at three lateral positions relative to the inductive proximity sensors.

Referring next to FIG. 8*a* wheel flange profiles 4,5 are shown on left and right rails 2,3 passing over inductive proximity sensors 8, 9. The axle 6 joining the wheels 4,5 in a wheel set is not shown for clarity. The sensor mounting brackets have been omitted for clarity.

In FIG. 8*a* the wheels in the wheel set have shifted toward the right rail 3. The flange tip point of left wheel profile 4 is within the left sensor 8 detection envelope E triggering the relay circuit in the sensor and generating the 10-volt output signal 18 shown for the left rail sensor 8. The flange tip point (FTP) of right wheel profile 5 has moved toward the right rail 3 and out of the right rail sensor 9 detection envelope such that the right sensor 9 relay is not triggered, and the output signal 18 remains 0 volts. The sensor voltage signal pattern 18 of 10 volts from the left rail sensor 8 and 0 volts from the right rail sensor 9 indicates that the wheel set is shifted toward the right rail.

Figure 8B:
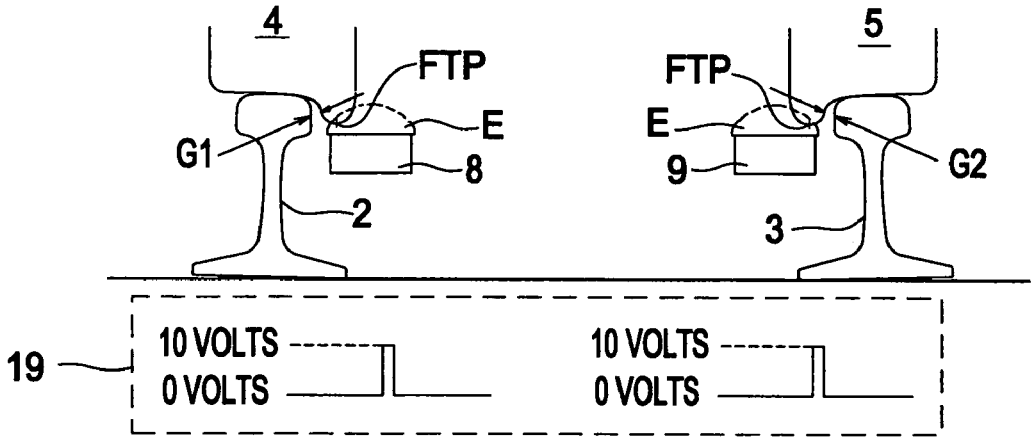

In FIG. 8*b* the wheels in the wheel set are centered between the rails 2, 3 such that the gaps $G_1$ and $G_2$ are equal. The flange tip point (FTP) of left wheel flange profile 4 is within the left sensor 8 detection envelope E triggering the relay circuit in the sensor 8 and generating the 10-volt output signal 19 shown for the left rail sensor 8. The flange tip point (FTP) of right wheel flange profile 5 is also within the right rail sensor 9 detection envelope E triggering the relay circuit and generating the 10-volt output signal 19. The sensor voltage signal pattern 19 of 10 volts from the left rail sensor 8 and 10 volts from the right rail sensor 9 indicates that the wheel set 4, 5 is centered between the rails 2, 3.

Figure 8C:
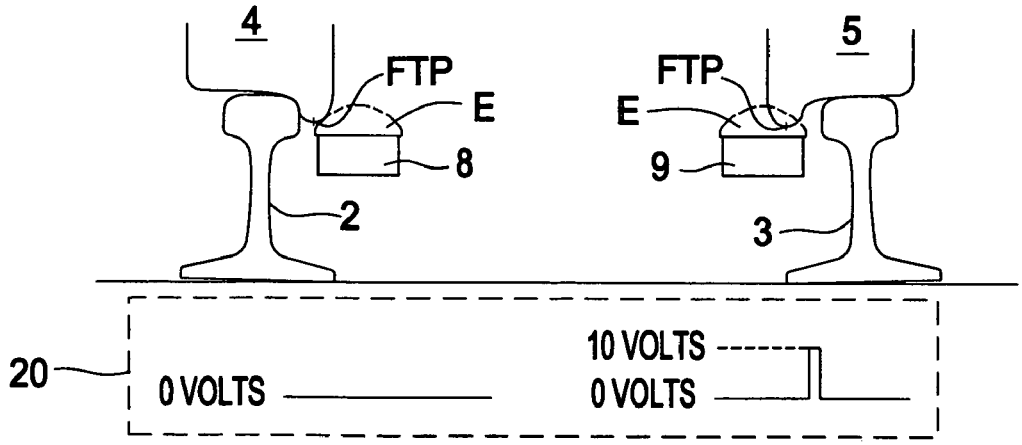

In FIG. 8*c* the wheels in the wheel set have shifted toward the left rail 2. The flange tip point FTP of the left wheel flange profile 4 has moved toward the left rail 2 and out of the left rail sensor 8 detection envelope E such that the sensor relay is not triggered, and the output signal 20 remains at 0 volts. The flange tip point of the right wheel flange profile 5 is within the right sensor 9 detection envelope E triggering the relay circuit in the sensor and generating the 10-volt signal 20 shown for the right rail sensor 9. The sensor voltage signal pattern 20 of 0 volts from the left rail sensor 8 and 10 volts from the right rail sensor 9 indicates that the wheel set 4,5 is shifted toward the left rail 2.

Figure 9A:
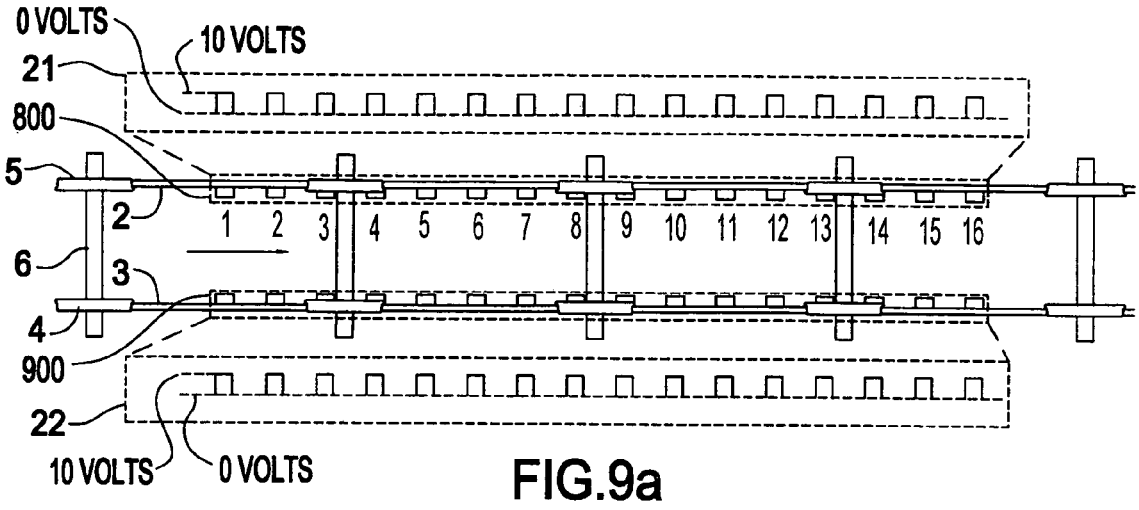
FIGS. 9*a*, 9*b*, 9*c* are three top views of a wheel set on the track with the inductive proximity sensor arrays.
Figure 9B:
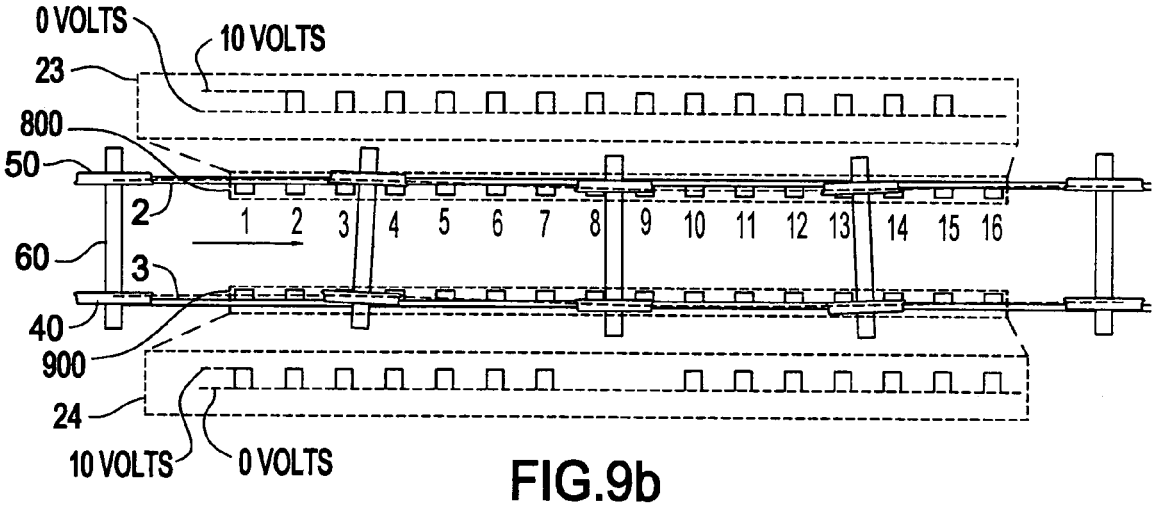
Figure 9C:
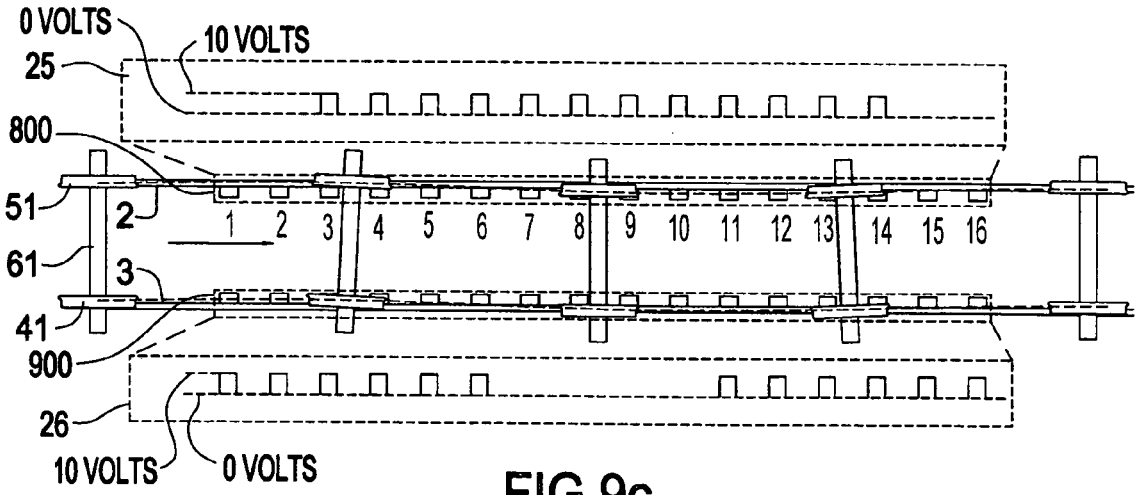

Referring next to FIGS. 9*a*-9*c* the proximity sensor array voltage signal patterns that correspond to different wheel set trajectories are shown. FIG. 9*a* shows a stable wheel set 4,5,6 tracking properly between the rails 2,3 through the test zone. The pattern of left rail sensors voltage signals 21 and right rail sensors voltage signals 22 corresponding to this trajectory are shown. All 16 sensors output 10-volt signals when the wheel passes over.

FIG. 9*b* shows a wheel set 40, 50, 60 exhibiting a slight lateral oscillation through the test zone. The pattern of sensor voltage signals 23,24 that correspond to this trajectory are shown. Sensors at positions 8 and 9 on the right rail 3 output 0-volt signals as the wheel passes over because the wheel set has moved toward flange contact with the right rail 3. Sensors at positions 1 and 16 on the left rail 2 output 0-volt signals as the wheel set passes over because the wheel has moved toward flange contact with the left rail 2.

FIG. 9*c* shows a wheel set 41, 51, 61 exhibiting more severe lateral oscillations through the test zone. The pattern of sensor voltage signals 25,26 corresponding to this trajectory are shown. Sensors at positions 7-10 on the right rail 3 output 0-volt signals as the wheel set passes over because the wheel set has moved toward flange contact with the left rail. Sensors at positions 1,2 and 15,16 on the left rail 2 output 0-volt signals as the wheel set passes over because-the-wheel set has moved toward flange contact with the left rail.

Comparing the patterns in FIGS. 9*b* and 9*c* reveals that the amplitude of the wheel set lateral oscillations is related to the pattern of inductive proximity sensor voltage signal outputs. The greater the number of adjacent proximity sensors with voltage signals of 0 volts the greater the lateral oscillation amplitude of the wheel set.

Figure 10A:
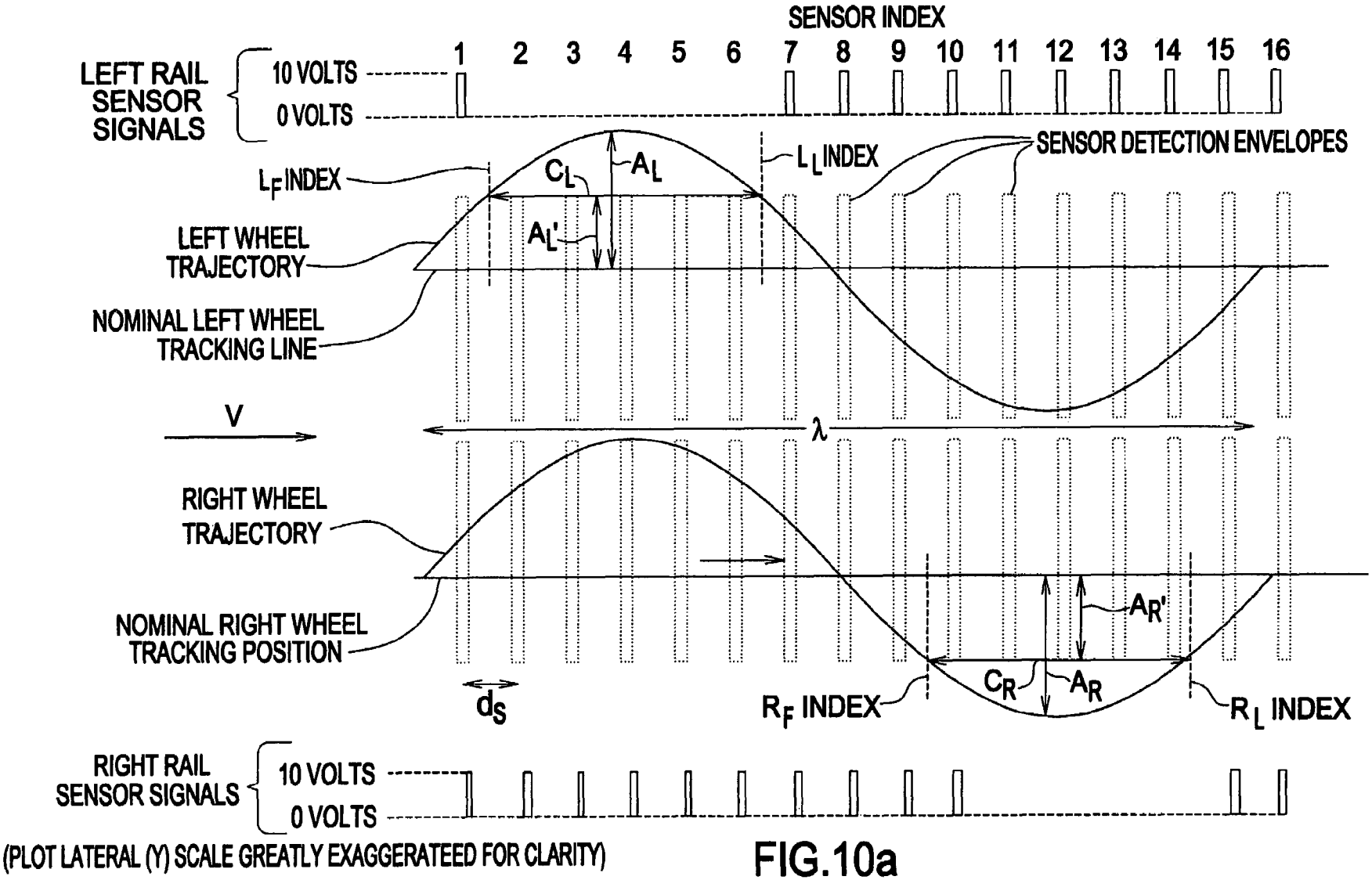
FIG. 10*a* shows plots of the trajectories of the wheels in an unstable wheel set, the inductive proximity sensor detection envelopes, and the resulting sensor voltage signals.

Referring next to FIG. 10 an example analysis of the inductive proximity sensor voltage signals for an unstable wheel set is shown. The lateral (y) scale of the plot in FIG. 10 is greatly exaggerated for clarity.

The algorithm first scans the left and right rail sensor voltage signals to find 0-volt readings that correspond to the wheels of an oscillating wheel set moving laterally toward the rail and outside of the sensor detection envelopes. In this example the wheel set shifted toward the left rail at sensor locations 2-6 and toward the right rail at sensors locations 11-14 as indicated by the 0-volt signals from these sensors.

Next, the algorithm determines the set of distance indices ($L_F$,$L_L$,$R_F$,$R_L$) corresponding to the positions of the first and last sensors signaling 0 volts according to EQS.1-4 in FIG. 10*b*. The distance indices of these locations are required to determine the approximate wavelength and lateral amplitude of the wheel set trajectory. Because the locations at which each wheel moved beyond the sensor detection envelopes may not occur precisely over a sensor, the algorithm assumes that these locations are half the distance between the outer 0-volt reading sensors and the adjacent 10-volt reading sensors on each rail as shown. This results in acceptably small errors in calculating the wheel set trajectory wavelength and lateral amplitude.

The wavelength $\lambda$ of the lateral wheel set sinusoidal oscillation is calculated from the average distance between the indices according to EQ. 5 in FIG. 10*b*.

Next, the right and left rail chord lengths $C_R$ and $C_L$ are calculated according to EQ. 6 and EQ. 7 in FIG. 10*b*.

The wavelength $\lambda$, right rail chord length $C_R$ and sensor lateral detection distance $A_R'$ from the nominal wheel lateral tracking line are used in EQ. 8 of FIG. 10*b* to calculate the maximum amplitude of the wheel set lateral oscillation toward the right rail $A_R$. Likewise the wavelength $\lambda$, left rail chord length $C_L$ and sensor lateral detection distance $A_L'$ are used in EQ. 9 of FIG. 10*b* to calculate the maximum amplitude of the wheel set lateral oscillation toward the left rail $A_L$. $A_R$ and $A_L$ are then averaged according to EQ. 10 in FIG. 10*b* to obtain the lateral amplitude A of the wheel set trajectory.

Next, the oscillatory frequency $\omega$ of the wheel set is calculated according to EQ. 11 in FIG. 10*b* using the wheel set forward velocity V and the lateral oscillation wavelength $\lambda$.

The maximum amplitude of the wheel set lateral acceleration $a_{max}$ is calculated from the average lateral oscillation amplitude A and the lateral oscillatory frequency $\omega$ according to EQ. 12 in FIG. 10*b*. The lateral instability detection system uses the maximum lateral acceleration $a_{max}$ as an indicator of the relative severity of the unstable lateral oscillations because the forces imposed on the railroad car suspension, on the railroad car lading and on the railroad track are proportional to the lateral acceleration.

Figure 11A:
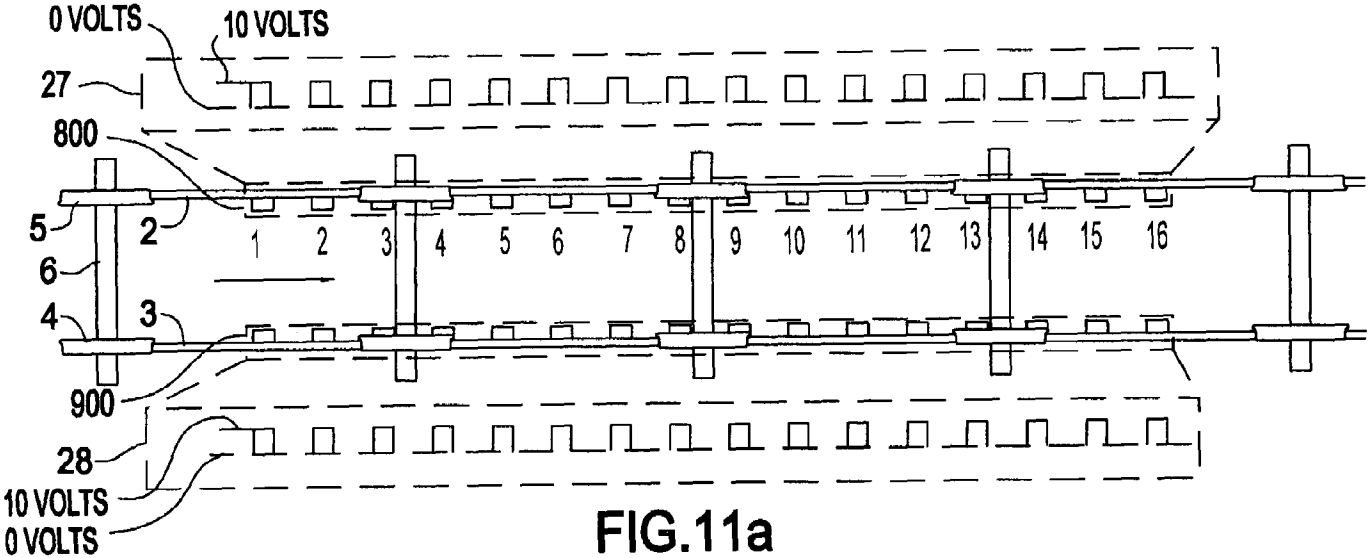
FIGS. 11*a*, 11*b* are two top views of wheel sets exhibiting different tracking positions on the track, the inductive proximity sensors and the resulting sensor voltage signals.
Figure 11B:
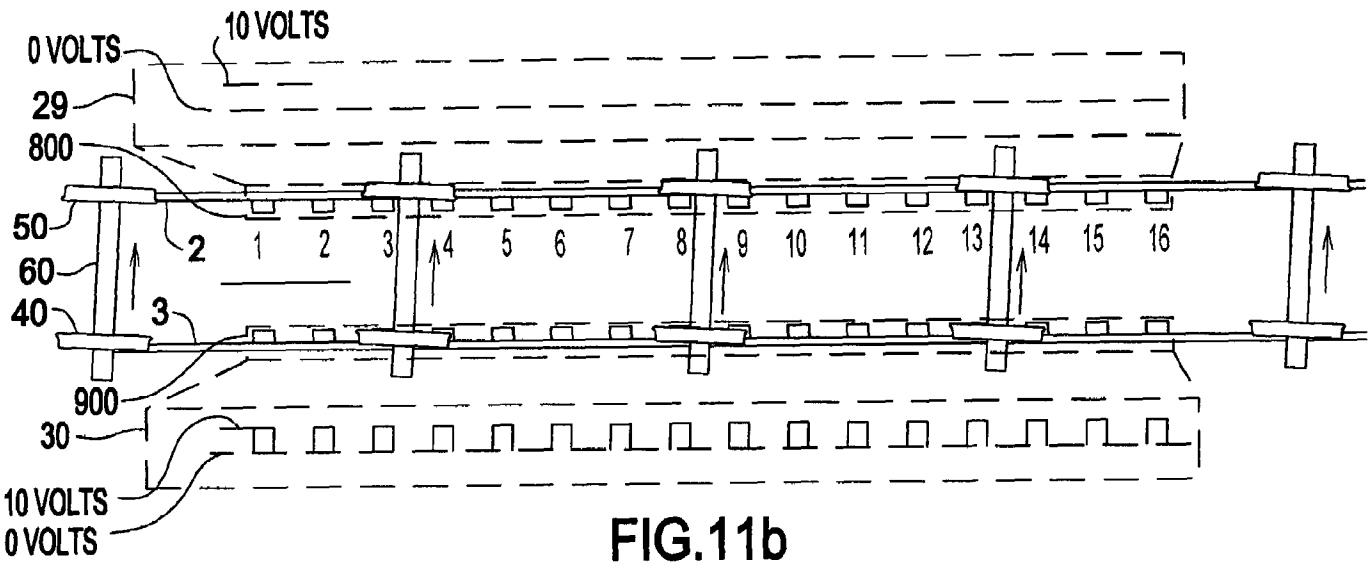

Referring next to FIGS. 11*a*, 11*b* the proximity sensor array voltage signal patterns 27,28 that correspond to different wheel set tracking trajectories are shown. FIG. 11*a* shows the sensor array voltage signal patterns for wheel set 4,5,6 centered between the rails 2,3 and tracking properly through the test zone. The sensor voltage signal patterns 27,28 on both rails show all sensors signaling 10 volts as the wheel set passes over.

FIG. 11*b* shows the sensor array voltage signal patterns 29, 30 for a wheel set 40, 50, 60 tracking consistently toward the left rail 2. The right rail sensor voltage pattern 30 shows all sensors signaling 10 volts while the left rail sensor voltage pattern 29 shows all sensors signaling 0 volts. The patterns 29, 30 of FIG. 11*b* would reverse if the wheel set 4, 5, 6 tracked consistently toward the right rail.

The tracking detector algorithm scans the sensor voltage signals for consistent readings of 10 volts from every sensor in the array on one rail and 0 volts from every sensor in the array on the other rail. If such patterns are found, then the wheel set is flagged as having a tracking error, and a report is issued identifying the wheel set by its position in the railroad car and the railroad car identification code.

Figure 12:
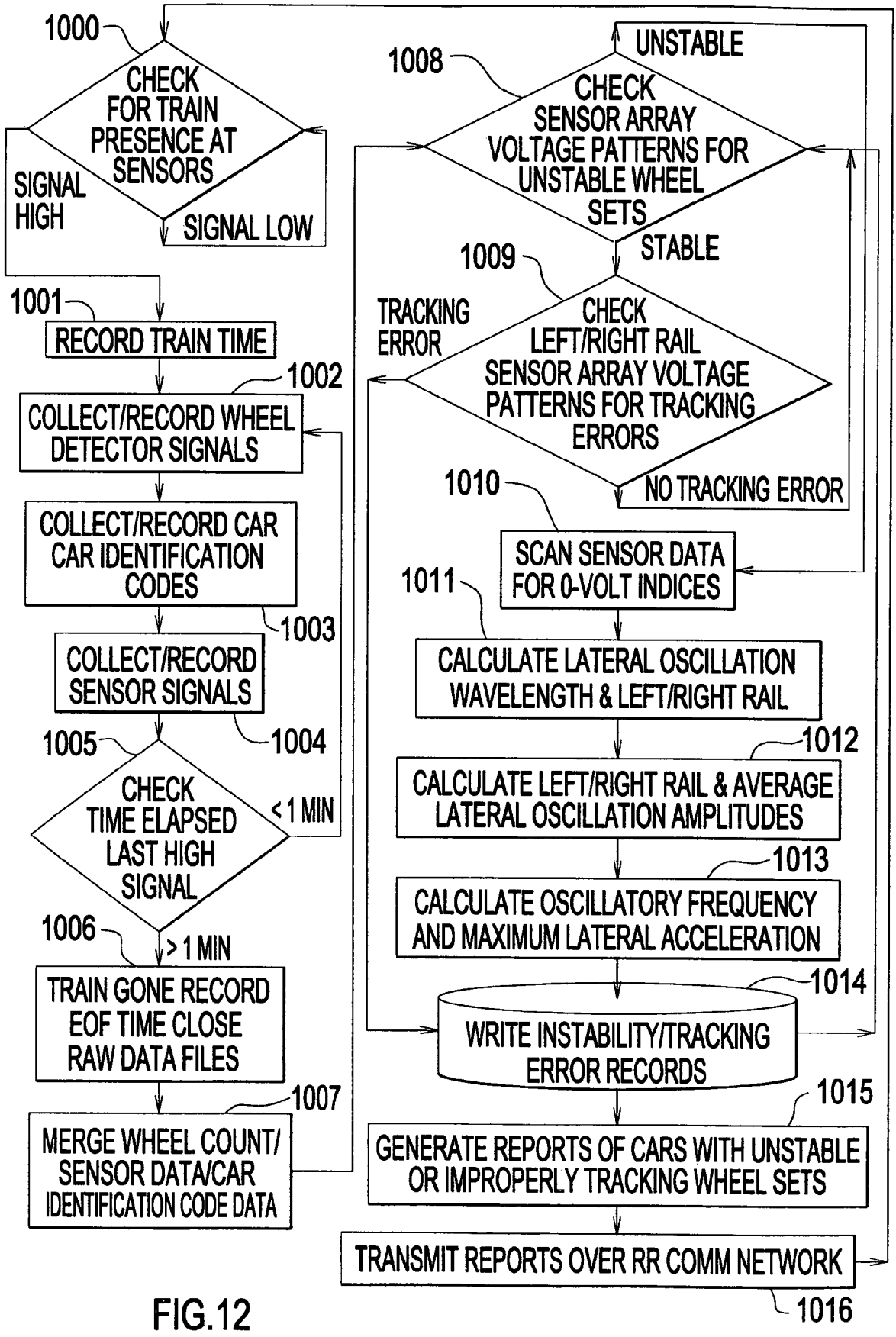
FIG. 12 is a logic flowchart of the program that collects and analyzes the inductive proximity sensors data and railroad car identification codes.

Referring next to FIG. 12 a logic flowchart for the program that collects and analyzes the sensor data and the railroad car identification codes is shown. The logic flow sequence is as follows:

1. Block 1000 monitors the inductive proximity sensors for high (10-volt) signals that indicate a train has arrived at the test zone.

2. When a sensor signal goes high block 1001 records the train time.

3. Block 1002 records the wheel detector (12 of system 1001) signals.

4. Block 1003 records the railroad car radio identification tag reader (13 of system 1001) data.

5. Block 1004 records the inductive proximity sensor array voltage signals.

6. Block 1005 monitors the elapsed time since the last sensor high signal to determine when the train has left the test zone. The program flows back to block 1002 if the train is still in the test zone.

7. If block 1005 determines that the train has left the test zone the program proceeds to block 1006 which records the end of file times and closes the files containing raw proximity sensor voltage signal data, wheel detector data and railroad car identification code data.

8. An algorithm operates in block 1007 that associates the wheel detector and railroad car identification code data with the proper proximity sensor array data for each wheel set and railroad car.

9. Block 1008 checks the proximity sensor array voltage patterns of the wheel set for lateral instability.

10. If block 1008 finds the current wheel set to be unstable then it proceeds to block 1010, which scans the proximity sensor array voltage patterns for the 0-volt index locations.

11. Block 1011 calculates the lateral oscillation wavelength for the left and right rails based on the locations of the 0-volt indices.

12. Block 1012 calculates the average lateral oscillation amplitudes for the left and right rail wheels.

13. Block 1013 calculates the oscillatory frequency of the wheel set from its linear velocity and oscillation wavelength and the maximum lateral acceleration of the wheel set.

14. Block 1014 writes the wheel set lateral instability records to a file on disk.

15. If the wheel set is found to be stable in block 1008 then the program proceeds to block 1009 which checks the proximity sensor array voltage signal patterns of the wheel set for tracking errors.

16. Block 1014 writes the wheel set tracking error records to a file on disk.

17. After the records for all of the wheel sets in the train are analyzed block 1015 generates an electronic report of the wheel sets and associated railroad cars that exhibit instability or tracking errors.

18. Block 1016 transmits the electronic report via the railroad communication network.

19. The program proceeds back to block 1000 to wait for proximity sensor signals indicating that a train is present at the test zone.

PREFERRED EMBODIMENT OF THE INVENTION

The preferred embodiment of the invention to detect lateral instability and tracking errors in North American freight railroad train service is shown in FIG. 4 and consists of:

1. Arrays of 16 inductive proximity sensor pairs 8,9 mounted on the left and right rails 2,3 of a railroad track 1 with a spacing of approximately 24 inches between sensor pairs.

2. Inductive proximity sensors 8,9 with a nominal detection range of 50 mm, an internal switching relay, a switching frequency of at least 250 Hz. and an operating voltage range of 10-30 VDC.

3. Inductive proximity mounting brackets (14-17 in FIGS. 6*a*, 6*b*) that mount the inductive proximity sensors on the rails such that the sensor face resides 1.60 inches below the top of rail and centered laterally 2.34 inches from the inside edge of the rail head.

4. A railroad car identification system 1001 in FIG. 4 comprised of the radio identification tag reader 13 and wheel detector 12.

5. An automatic data collection and control computer 10 in FIG. 4 that monitors and records the signals from the inductive proximity sensors, applies algorithms to analyze the sensor signals, records the railroad car radio identification tag information, generates reports and transmits them over the communication link 11 to the railroad network.

6. A straight section of railroad track with minimal surface and alignment deviations and average train speeds above 50 mph.

Alternative embodiments of the invention are appropriate for other railroad applications such as high-speed passenger trains. In this application the inductive sensor design and spacing would be modified to detect the longer wavelength lateral oscillations and higher operating speeds of passenger railroad cars. Another less expensive embodiment would only use a single left or right array to compare a pattern deviating from a chosen normal pattern of wheel segments either in or out of a set of proximity sensor envelopes.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

The invention claimed is:

1. A railroad car lateral instability/tracking detection system for detecting wheel and/or truck tracking errors, the system comprising:

a plurality of proximity sensors mounted adjacent to a left rail of a railroad track;

a plurality of proximity sensors mounted adjacent to a right rail of the railroad track;

wherein most left proximity sensors oppose a respective right proximity sensor to enable a concurrent sensing of a left and a right wheel of a passing wheel set;

an applied voltage to the proximity sensors;

a data collection/control computer (DCCC);

wherein a passing wheel set without lateral instability changes an electrical field of each of the left and the right proximity sensors, thereby creating a first output signal to the DCCC which is displayed by the DCCC as a normal wheel set; and wherein a passing wheel set with lateral instability changes the electric field of only one of the left and the right proximity sensors, thereby creating a second output signal to the DCCC, which is displayed by the DCCC as an abnormal wheel set having a tracking error.

2. The system of claim 1 further comprising a railroad car identification system having a tag reader and a wheel detector, wherein the DCCC program correlates a wheel set to a railroad car identity.

3. The system of claim 1, wherein the proximity sensors have a detection range of about 0 millimeter to less than about 100 millimeters.

4. The system of claim 1, wherein the proximity sensors each further comprise a mounting bracket and a clamp means functioning to secure the mounting bracket to the track at a chosen distance from a top segment of the rail.

5. The system of claim 1, wherein the output signal is either a zero volt output for a flange tip point (FTP) outside a detection envelope or a set voltage output for a FTP inside the detection envelope.

6. The system of claim 5, wherein the DCCC program computes a shift left or right of a wheel set by sensing a zero volt/set voltage output pattern from opposing sensors.

7. The system of claim 6, wherein a lateral oscillation amplitude of a wheel set is computed by the DCCC program as a function of sequential zero volt signals.

8. The system of claim 6, wherein the DCCC program uses a maximum lateral acceleration as an indicator of a relative severity of lateral instability.

9. A railroad car wheel lateral position tracking detection system comprising:

an array of left rail proximity sensors mounted to a left rail of a track;

an array of right rail proximity sensors mounted to a right rail of the track, forming a plurality of opposing pairs of sensors;

a control computer connected to the arrays to sense a wheel segment in a detection envelope pattern in a plurality of opposing pairs of sensors; and wherein a wheel segment of each of a left and a right wheel sensed by the left and the right rail proximity sensor detection envelope is displayed by the control computer as a normal wheel left to right tracking pattern;

wherein a deviation from at the normal left to right tracking pattern determines a tracking error in the control computer; and further comprising a railroad car identification system connected to the control computer to compare which railroad car has a wheel set with a tracking error.

10. The system of claim 9, wherein the wheel segment in a detection envelope pattern further comprises a flange tip point (FTP) of a wheel either being outside the detection envelope or inside the detection envelope, thereby triggering a chosen output signal.

11. A railroad car wheel tracking detection system comprising:

an array of left rail proximity sensors mounted to a left rail of a track;

an array of right rail proximity sensors mounted to a right rail of the track, forming a plurality of opposing pairs of sensors;

a control computer connected to the arrays to sense a wheel segment in a detection envelope pattern in a plurality of opposing pairs of sensors;

wherein a deviation from a normal pattern determines a tracking error; and further comprising a railroad car identification system connected to the control computer to compare which railroad car has a wheel set with a tracking error.

* * * * *